US010685563B2

(12) United States Patent
Edwards et al.

(10) Patent No.: US 10,685,563 B2
(45) Date of Patent: Jun. 16, 2020

(54) APPARATUS, SYSTEMS, AND METHODS FOR DETECTING, ALERTING, AND RESPONDING TO AN EMERGENCY VEHICLE

(71) Applicant: TOYOTA MOTOR NORTH AMERICA, INC., Plano, TX (US)

(72) Inventors: Michael C. Edwards, McKinney, TX (US); Neil Dutta, Addison, TX (US)

(73) Assignee: TOYOTA MOTOR NORTH AMERICA, INC., Plano, TX (US)

( * ) Notice: Subject to any disclaimer, the term of this patent is extended or adjusted under 35 U.S.C. 154(b) by 0 days.

(21) Appl. No.: 16/184,497

(22) Filed: Nov. 8, 2018

(65) Prior Publication Data

US 2020/0152058 A1 May 14, 2020

(51) Int. Cl.
*G08G 1/0965* (2006.01)

(52) U.S. Cl.
CPC ..... *G08G 1/0965* (2013.01)

(58) Field of Classification Search
CPC combination set(s) only.
See application file for complete search history.

(56) References Cited

U.S. PATENT DOCUMENTS 9,659,494 B2 5/2017 Rider et al.
10,008,111 B1 6/2018 Grant
2003/0141990 A1* 7/2003 Coon ..... G08G 1/0965 340/902
2014/0091949 A1 4/2014 Tickoo et al.
2016/0009222 A1* 1/2016 Taylor ..... G08G 1/0965 340/902
2016/0286458 A1* 9/2016 Rofougaran ..... H04B 7/2606
2016/0339928 A1 11/2016 Mankin et al.
2016/0358466 A1 12/2016 Youngblood
2017/0323562 A1* 11/2017 Rech ..... G08G 1/017

FOREIGN PATENT DOCUMENTS

JP 2001338393 A 12/2001
WO 2017151937 A1 9/2017

* cited by examiner

*Primary Examiner* — Nabil H Syed
*Assistant Examiner* — Cal J Eustaquio
(74) *Attorney, Agent, or Firm* — Haynes & Boone LLP

(57) ABSTRACT

Apparatus, systems, and methods for detecting, alerting, and responding to an emergency vehicle. One such method includes receiving, using a first vehicle, a warning signal from an emergency vehicle. The first vehicle broadcasts a recognition signal based on the warning signal received by the first vehicle. A second vehicle receives the warning signal from the emergency vehicle and the recognition signal from the first vehicle. The second vehicle broadcasts a confirmation signal based on both the warning signal and the recognition signal received by the second vehicle. The confirmation signal is received from the second vehicle using a third vehicle. Finally, the confirmation signal is rebroadcasted from the third vehicle based solely on the confirmation signal received by the third vehicle.

17 Claims, 5 Drawing Sheets

APPARATUS, SYSTEMS, AND METHODS FOR DETECTING, ALERTING, AND RESPONDING TO AN EMERGENCY VEHICLE

TECHNICAL FIELD

The present disclosure relates generally to emergency vehicles and, more particularly, to apparatus, systems, and methods for detecting, alerting, and responding to an emergency vehicle.

BACKGROUND

Emergency vehicles such as fire trucks, law enforcement vehicles, military vehicles, and ambulances are often permitted by law, when responding to an emergency situation, to break conventional road rules in order to reach their destinations as quickly as possible (e.g., traffic lights, speed limits, etc.). To help reduce the risk of potential collisions with pedestrians and other vehicles, emergency vehicles are typically fitted with audible and/or visual warning devices, such as sirens and flashing lights, designed to alert the surrounding area of the emergency vehicle's presence. However, these warning devices alone are not always effective. For example, depending on the relative location/position of a given pedestrian or vehicle, the flashing lights of an emergency vehicle may be obscured such that the flashing lights are not be visible in time to provide a sufficient warning period. Furthermore, the siren may be obscured due to ambient noise, headphones, speakers, a person's hearing impairment, or the like such the siren would not be audible in time to provide a sufficient warning period. Depending on how quickly a given driver realizes the presence of an emergency vehicle, he or she may not have sufficient time to react accordingly by, for example, pulling his or her vehicle to the side of the road to clear a path for the emergency vehicle to pass. Therefore, what is needed is an apparatus, system, or method that addressed on or more of the foregoing issues, and/or one or more other issues.

SUMMARY

Figure 1:
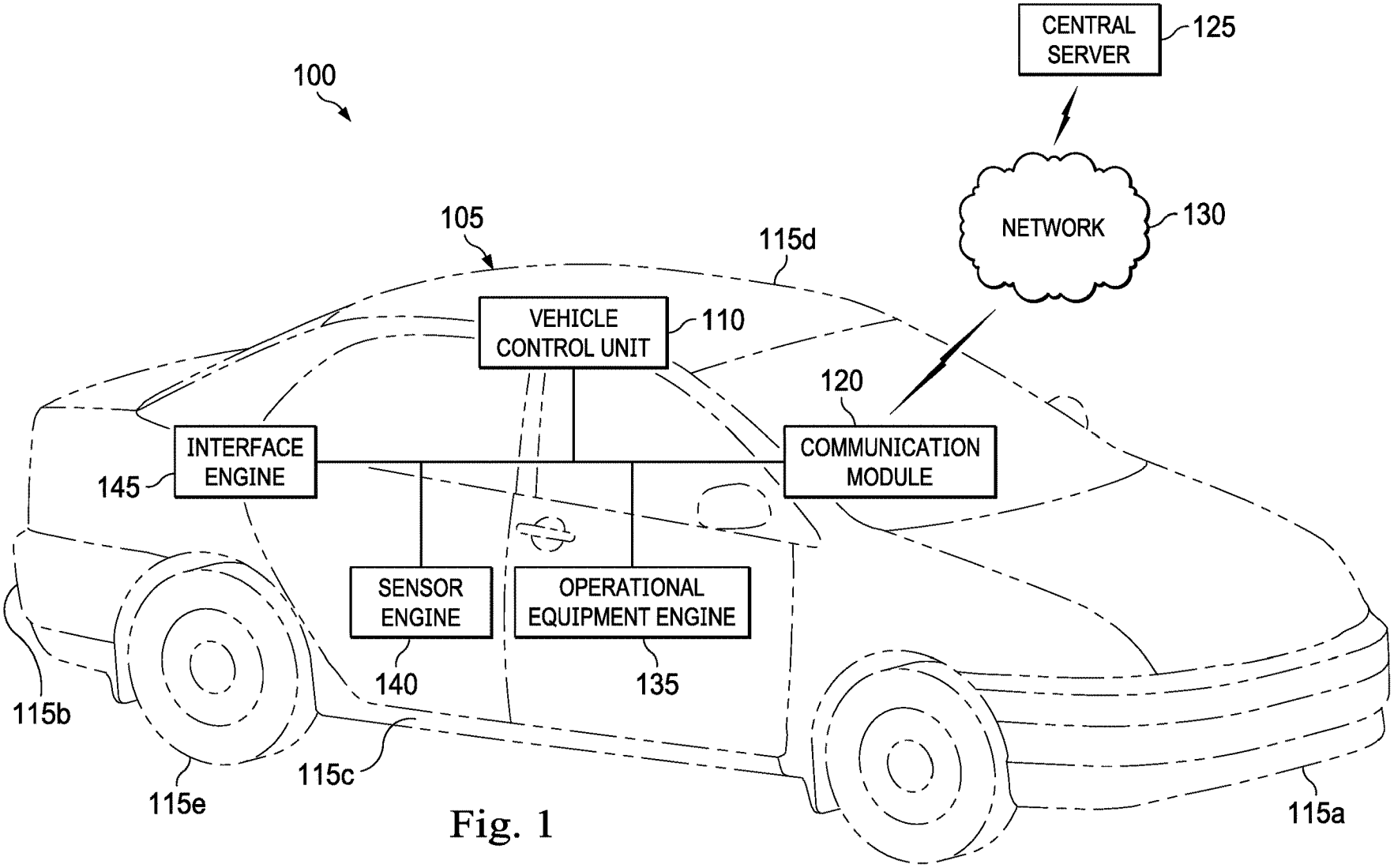
FIG. 1 is a diagrammatic illustration of an emergency vehicle detection apparatus, according to one or more embodiments of the present disclosure.

The present disclosure provides apparatus, systems, and methods for detecting, alerting, and responding to an emergency vehicle. A generalized method includes receiving, using a first vehicle, a warning signal from an emergency vehicle. The first vehicle broadcasts a recognition signal based on the warning signal received by the first vehicle. A second vehicle receives the warning signal from the emergency vehicle and the recognition signal from the first vehicle. The second vehicle broadcasts a confirmation signal based on both the warning signal and the recognition signal received by the second vehicle.

A generalized system includes an emergency vehicle adapted to broadcast a warning signal. A first vehicle is adapted to receive the warning signal from the emergency vehicle, wherein the first vehicle is further adapted to broadcast a recognition signal based on the warning signal received by the first vehicle. A second vehicle adapted to receive the warning signal from the emergency vehicle and the recognition signal from the first vehicle, wherein the second vehicle is further adapted to broadcast a confirmation signal based on both the warning signal and the recognition signal received by the second vehicle.

A generalized apparatus includes a non-transitory computer readable medium and a plurality of instructions stored on the non-transitory computer readable medium and executable by one or more processors. The plurality of instructions includes instructions that, when executed, cause the one or more processors to receive, using a first vehicle, a warning signal from an emergency vehicle. The plurality of instructions also includes instructions that, when executed, cause the one or more processors to broadcast, from the first vehicle, a recognition signal based on the warning signal received by the first vehicle. The plurality of instructions also includes instructions that, when executed, cause the one or more processors to receive, using a second vehicle, the warning signal from the emergency vehicle and the recognition signal from the first vehicle. The plurality of instructions also includes instructions that, when executed, cause the one or more processors to broadcast, from the second vehicle, a confirmation signal based on both the warning signal and the recognition signal received by the second vehicle.

DETAILED DESCRIPTION

The present disclosure describes a system for electronic tracking and driver notification of upcoming emergency vehicles based on a route travelled or to be travelled by the emergency vehicles. Existing map and GPS systems may provide an update on a map that indicates congestion ahead, and may recommend alternate routes, but do not provide driver notification of upcoming emergency vehicles. As a result, drivers don't pull over until they hear the siren or see the emergency lights of an approaching emergency vehicle. The system provides drivers with an alert or indication that emergency vehicles are approaching. This allows drivers to properly respond by pulling out of the way or seeking an alternative route. In addition, the system may recommend an alternative route to avoid the approaching emergency vehicles and/or the emergency ahead. More particularly, the system may operate as a centralized system or a decentralized system. For example, in one embodiment of a centralized system, an emergency dispatch (e.g., a 911 operator) is made and the dispatcher broadcasts out to a central server, which server passes the information to individual vehicle control units using cell-towers. The information may be broadcast to vehicles along the estimated route to be traveled by the emergency vehicle. Accordingly, the destination of the emergency vehicle may also be included in the broadcast. An output device or display may notify the driver that emergency vehicles are approaching. In some implementations, depending upon the route of the emergency vehicle, a vehicle-based navigation system may recommend an alternative route to avoid the emergency scene even before the emergency vehicles arrive.

For another example, in one embodiment of a decentralized system in which the emergency vehicle is enabled to work with the system, the emergency vehicle may operate as a part of a vehicle-to-vehicle ("V2V") system to transmit signals ahead to cars along the route it will travel so that drivers of those cars may take remedial action. The range of the transmission may be faster than would be obtained through conventional sound and vision notifications. The emergency vehicle may broadcast its destination so other vehicles can navigate around the emergency scene. In some implementations, enabled cars may communicate to each other to pass the emergency information ahead of the emergency vehicle. In some instances, the driver alert may include info regarding the type of vehicle approaching, whether ambulance, police car, or fire truck. Accordingly, the system would identify incidents approaching from behind the vehicle and not just in front of the vehicle. For yet another example, in another embodiment of a decentralized system in which the emergency vehicle is not enabled to work with the system, "smart" vehicles along the route may recognize the emergency vehicle (e.g., visible flashing lights and/or audible sirens) and broadcast a recognition of the emergency vehicle. An algorithm may help with accuracy. For example, if multiple vehicles (e.g., two, three, or more) along the same route recognize and broadcast the same recognition of an emergency vehicle, then other vehicles may relay that message to vehicles along the route.

Referring to FIG. 1, in an embodiment, an emergency vehicle detection, alert, and response system is generally referred to by the reference numeral 100 and includes a vehicle 105, such as an automobile, and a vehicle control unit 110 located on the vehicle 105. The vehicle 105 may include a front portion 115*a* (including a front bumper), a rear portion 115*b* (including a rear bumper), a right side portion 115*c* (including a right front quarter panel, a right front door, a right rear door, and a right rear quarter panel), a left side portion 115*d* (including a left front quarter panel, a left front door, a left rear door, and a left rear quarter panel), and wheels 115*e*. A communication module 120 is operably coupled to, and adapted to be in communication with, the vehicle control unit 110. The communication module 120 is adapted to communicate wirelessly with a central server 125 via a network 130 (e.g., a 3G network, a 4G network, a 5G network, a Wi-Fi network, an ad hoc network, or the like).

An operational equipment engine 135 is operably coupled to, and adapted to be in communication with, the vehicle control unit 110. A sensor engine 140 is operably coupled to, and adapted to be in communication with, the vehicle control unit 110. The sensor engine 140 is adapted to monitor various components of, for example, the operational equipment engine 135 and/or the surrounding environment, as will be described in further detail below. An interface engine 145 is operably coupled to, and adapted to be in communication with, the vehicle control unit 110. In addition to, or instead of, being operably coupled to, and adapted to be in communication with, the vehicle control unit 110, the communication module 120, the operational equipment engine 135, the sensor engine 140, and/or the interface engine 145 may be operably coupled to, and adapted to be in communication with, one another via wired or wireless communication (e.g., via an in-vehicle network). In some embodiments, as in FIG. 1, the vehicle control unit 110 is adapted to communicate with the communication module 120, the operational equipment engine 135, the sensor engine 140, and the interface engine 145 to at least partially control the interaction of data with and between the various components of the emergency vehicle detection, alert, and response system 100.

The term "engine" is meant herein to refer to an agent, instrument, or combination of either, or both, agents and instruments that may be associated to serve a purpose or accomplish a task—agents and instruments may include sensors, actuators, switches, relays, power plants, system wiring, computers, components of computers, programmable logic devices, microprocessors, software, software routines, software modules, communication equipment, networks, network services, and/or other elements and their equivalents that contribute to the purpose or task to be accomplished by the engine. Accordingly, some of the engines may be software modules or routines, while others of the engines may be hardware and/or equipment elements in communication with the vehicle control unit 110, the communication module 120, the network 130, and/or the central server 125.

Figure 2:
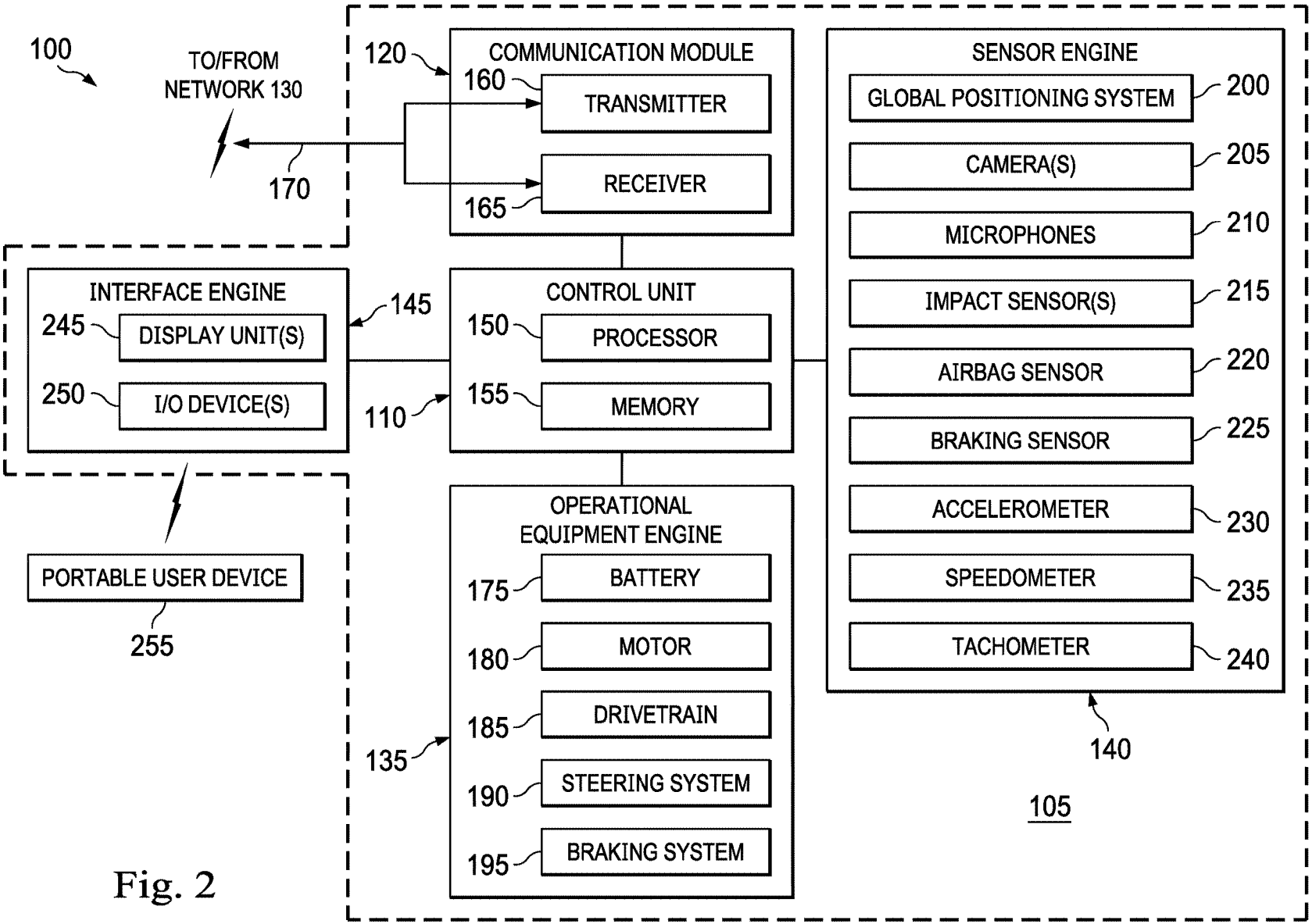
FIG. 2 is a detailed diagrammatic view of the emergency vehicle detection apparatus of FIG. 1, according to one or more embodiments of the present disclosure.

Referring to FIG. 2, a detailed diagrammatic view of the system 100 of FIG. 1 is illustrated. As shown in FIG. 2, the vehicle control unit 110 includes a processor 150 and a memory 155. In some embodiments, as in FIG. 2, the communication module 120, which is operably coupled to, and adapted to be in communication with, the vehicle control unit 110, includes a transmitter 160 and a receiver 165. In some embodiments, one or the other of the transmitter 160 and the receiver 165 may be omitted according to the particular application for which the communication module 120 is to be used. In some embodiments, the transmitter 160 and the receiver 165 are combined into a transceiver capable of both sending and receiving wireless signals. In any case, the transmitter 160 and the receiver 165 are adapted to send/receive data to/from the network 130, as indicated by arrow(s) 170.

In some embodiments, as in FIG. 2, the operational equipment engine 135, which is operably coupled to, and adapted to be in communication with, the vehicle control unit 110, includes a plurality of devices configured to facilitate driving of the vehicle 105. In this regard, the operational equipment engine 135 may be designed to exchange communication with the vehicle control unit 110, so as to not only receive instructions, but to provide information on the operation of the operational equipment engine 135. For example, the operational equipment engine 135 may include a vehicle battery 175, a motor 180 (e.g., electric or combustion), a drivetrain 185, a steering system 190, and a braking system 195. The vehicle battery 175 provides electrical power to the motor 180, which motor 180 drives the wheels 115*e* of the vehicle 105 via the drivetrain 185. In some embodiments, in addition to providing power to the motor 180, the vehicle battery 175 provides electrical power to other component(s) of the operational equipment engine 135, the vehicle control unit 110, the communication module 120, the sensor engine 140, the interface engine 145, or any combination thereof.

In some embodiments, as in FIG. 2, the sensor engine 140, which is operably coupled to, and adapted to be in communication with, the vehicle control unit 110, includes devices such as sensors, meters, detectors, or other devices configured to measure or sense a parameter related to a driving operation of the vehicle 105, as will be described in further detail below. For example, the sensor engine 140 may include a global positioning system 200, vehicle camera(s) 205, vehicle microphone(s) 210, vehicle impact sensor(s) 215, an airbag sensor 220, a braking sensor 225, an accelerometer 230, a speedometer 235, a tachometer 240, or any combination thereof. The sensors or other detection devices are generally configured to sense or detect activity, conditions, and circumstances in an area to which the device has access. Sub-components of the sensor engine 140 may be deployed at any operational area where readings regarding the driving of the vehicle 105 may be taken. Readings from the sensor engine 140 are fed back to the vehicle control unit 110. The reported data may include the sensed data, or may be derived, calculated, or inferred from sensed data. The vehicle control unit 110 may send signals to the sensor engine 140 to adjust the calibration or operating parameters of the sensor engine 140 in accordance with a control program in the vehicle control unit 110. The vehicle control unit 110 is adapted to receive and process data from the sensor engine 140 or from other suitable source(s), and to monitor, store (e.g., in the memory 155), and/or otherwise process (e.g., using the processor 150) the received data.

The global positioning system 200 is adapted to track the location of the vehicle 105 and to communicate the location information to the vehicle control unit 110. The vehicle camera(s) 205 are adapted to monitor the vehicle 105's surroundings and the communicate image data to the vehicle control unit 110. The vehicle microphone(s) 210 are adapted to monitor the vehicle 105's surroundings and the communicate noise data to the vehicle control unit 110. The vehicle impact sensor(s) 215 are adapted to detect an impact of the vehicle with another vehicle or object, and to communicate the impact information to the vehicle control unit 110. In some embodiments, the vehicle impact sensor(s) 215 is or includes a G-sensor. In some embodiments, the vehicle impact sensor(s) 215 is or includes a microphone. In some embodiments, the vehicle impact sensor(s) 215 includes multiple vehicle impact sensors, respective ones of which may be incorporated into the front portion 115*a* (e.g., the front bumper), the rear portion 115*b* (e.g., the rear bumper), the right side portion 115*c* (e.g., the right front quarter panel, the right front door, the right rear door, and/or the right rear quarter panel), and/or the left side portion 115*d* (e.g., the left front quarter panel, the left front door, the left rear door, and/or the left rear quarter panel) of the vehicle 105. The airbag sensor 220 is adapted to activate and/or detect deployment of the vehicle 105's airbag(s) and to communicate the airbag deployment information to the vehicle control unit 110. The braking sensor 225 is adapted to monitor usage of the vehicle 105's braking system 195 (e.g., an antilock braking system 195) and to communicate the braking information to the vehicle control unit 110.

The accelerometer 230 is adapted to monitor acceleration of the vehicle 105 and to communicate the acceleration information to the vehicle control unit 110. The accelerometer 230 may be, for example, a two-axis accelerometer 230 or a three-axis accelerometer 230. In some embodiments, the accelerometer 230 is associated with an airbag of the vehicle 105 to trigger deployment of the airbag. The speedometer 235 is adapted to monitor speed of the vehicle 105 and to communicate the speed information to the vehicle control unit 110. In some embodiments, the speedometer 235 is associated with a display unit of the vehicle 105 such as, for example, a display unit of the interface engine 145, to provide a visual indication of vehicle speed to a driver of the vehicle 105. The tachometer 240 is adapted to monitor the working speed (e.g., in revolutions-per-minute) of the vehicle 105's motor 180 and to communicate the angular velocity information to the vehicle control unit 110. In some embodiments, the tachometer 240 is associated with a display unit of the vehicle 105 such as, for example, a display unit of the interface engine 145, to provide a visual indication of the motor 180's working speed to the driver of the vehicle 105.

In some embodiments, as in FIG. 2, the interface engine 145, which is operably coupled to, and adapted to be in communication with, the vehicle control unit 110, includes at least one input and output device or system that enables a user to interact with the vehicle control unit 110 and the functions that the vehicle control unit 110 provides. For example, the interface engine 145 may include a display unit 245 and an input/output ("I/O") device 250. The display unit 245 may be, include, or be part of multiple display units. For example, in some embodiments, the display unit 245 may include one, or any combination, of a central display unit associated with a dash of the vehicle 105, an instrument cluster display unit associated with an instrument cluster of the vehicle 105, and/or a heads-up display unit associated with the dash and a windshield of the vehicle 105; accordingly, as used herein the reference numeral 245 may refer to one, or any combination, of the display units. The I/O device 250 may be, include, or be part of a communication port (e.g., a USB port), a Bluetooth communication interface, a touch-screen display unit, soft keys associated with a dash, a steering wheel, or another component of the vehicle 105, and/or similar components. Other examples of sub-components that may be part of the interface engine 145 include, but are not limited to, audible alarms, visual alerts, tactile alerts, telecommunications equipment, and computer-related components, peripherals, and systems.

In some embodiments, a portable user device 255 belonging to an occupant of the vehicle 105 may be coupled to, and adapted to be in communication with, the interface engine 145. For example, the portable user device 255 may be coupled to, and adapted to be in communication with, the interface engine 145 via the I/O device 250 (e.g., the USB port and/or the Bluetooth communication interface). In an embodiment, the portable user device 255 is a handheld or otherwise portable device which is carried onto the vehicle 105 by a user who is a driver or a passenger on the vehicle 105. In addition, or instead, the portable user device 255 may be removably connectable to the vehicle 105, such as by temporarily attaching the portable user device 255 to the dash, a center console, a seatback, or another surface in the vehicle 105. In another embodiment, the portable user device 255 may be permanently installed in the vehicle 105. In some embodiments, the portable user device 255 is, includes, or is part of one or more computing devices such as personal computers, personal digital assistants, cellular devices, mobile telephones, wireless devices, handheld devices, laptops, audio devices, tablet computers, game consoles, cameras, and/or any other suitable devices. In several embodiments, the portable user device 255 is a smartphone such as, for example, an iPhone® by Apple Inc.

Figure 3:
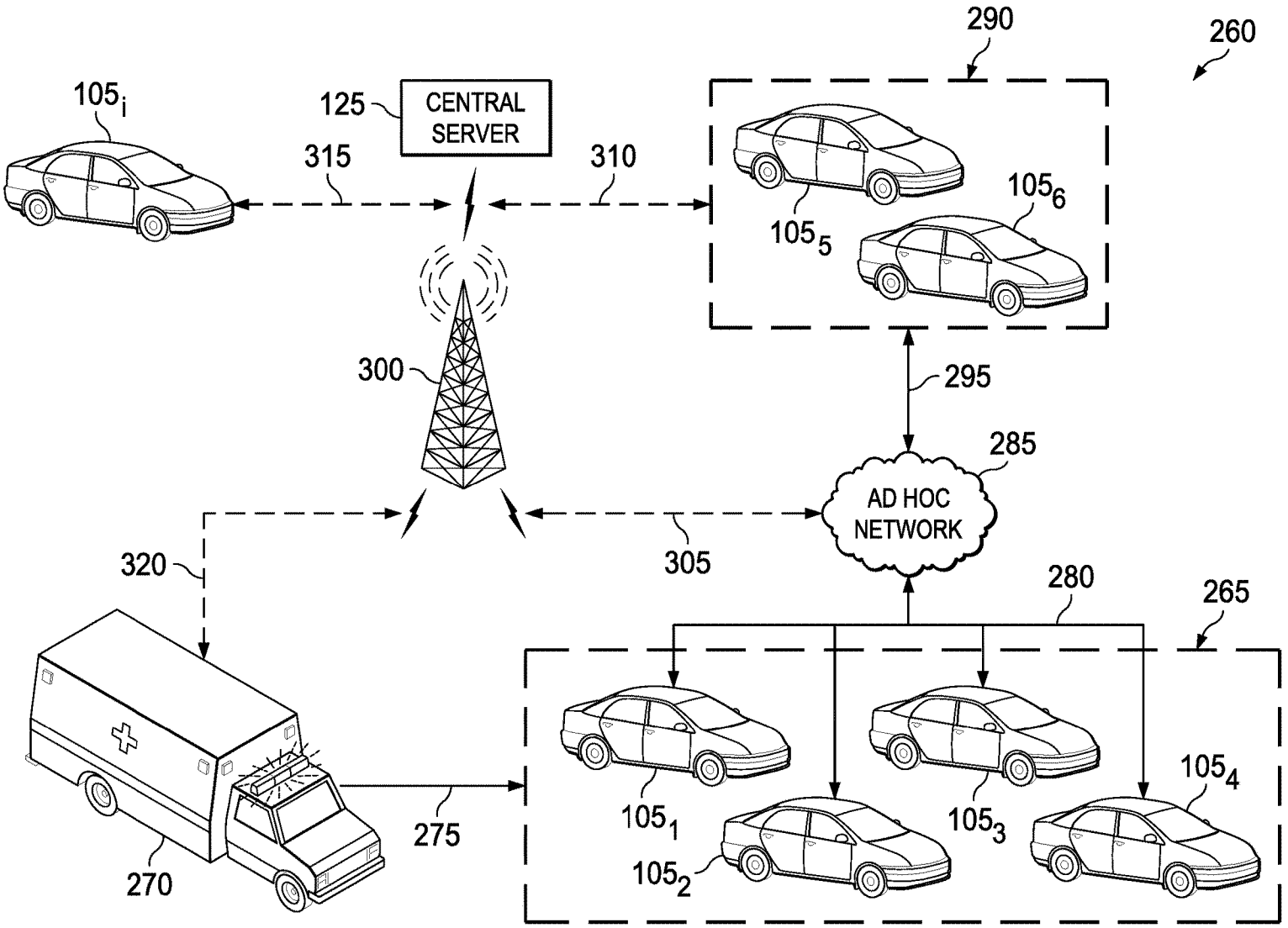
FIG. 3 is a diagrammatic illustration of an emergency vehicle detection, alert, and response system including at least the emergency vehicle detection apparatus of FIGS. 1 and 2, according to one or more embodiments of the present disclosure.

Referring to FIG. 3, in an embodiment, an emergency vehicle detection, alert, and response system is generally referred to by the reference numeral 260 and includes several components of the system 100. More particularly, the system 260 includes a plurality of vehicles substantially identical to the vehicle 105 of the system 100, which vehicles are given the same reference numeral 105, except that a subscript 1, 2, 3, 4, 5, 6, or i is added to each as a suffix. In some embodiments, as in FIG. 3, the system 260 includes the vehicles $\mathbf{105}_{1\text{-}4}$, which form a vehicle group 265 whose current location is in the vicinity of an emergency vehicle 270. As it approaches the vehicle group 265, the emergency vehicle 270 is adapted to send a warning signal toward the vehicle group 265, as indicated by arrow 275. In some embodiments, the warning signal 275 may be or include visible flashing lights and/or an audible siren. In addition, or instead, the warning signal 275 may be or include an electromagnetic signal (e.g., a radio signal) sent toward the vehicle group 265, which electromagnetic signal may include, for example, data relating to a location, a direction of travel, a speed, a destination, and/or a route of the emergency vehicle 270. Since the vehicle group 265 is located in the vicinity of the emergency vehicle 270, one or more of the respective sensor engines or communication devices of the vehicles $\mathbf{105}_{1\text{-}4}$ are adapted to detect the warning signal 275 sent by the emergency vehicle 270. For example, the emergency vehicle 270 flashing lights and/or siren may be detected using the vehicle camera(s) and/or the vehicle microphone(s) of one or more of the vehicles $\mathbf{105}_{1\text{-}4}$. For another example, the electromagnetic signal sent by the emergency vehicle 270 may be detected using the communication modules of one or more of the vehicles $\mathbf{105}_{1\text{-}4}$. In addition, the vehicles $\mathbf{105}_{1\text{-}4}$ are adapted to communicate with one another via their respective communication modules, as indicated by arrow(s) 280, so as to form an ad hoc network 285.

In some embodiments, as in FIG. 3, the system 260 also includes the vehicles $\mathbf{105}_{5\text{-}6}$, which are not located in the vicinity of the emergency vehicle 270, but instead form a vehicle group 290 whose route intersects a route of the emergency vehicle 270. If the physical distance between the vehicle group 290 and the vehicle group 265 is close enough to permit direct V2V communication therebetween (e.g., within range of the ad hoc network 285), one or more of the vehicles $\mathbf{105}_{5\text{-}6}$ is adapted to communicate with one or more of the vehicles $\mathbf{105}_{1\text{-}4}$ via their respective communication modules, as indicated by arrow 295, so as to form part of the ad hoc network 285. In contrast, if the physical distance between the vehicle group 290 and the vehicle group 265 is not close enough to permit direct V2V communication therebetween (e.g., not within range of the ad hoc network 285), one or more of the vehicles $\mathbf{105}_{1\text{-}4}$ forming the ad hoc network 285 may be further adapted to communicate via another communication protocol such as, for example, a cellular network 300, as indicated by arrow 305. In such embodiments, one or more of the vehicles $\mathbf{105}_{5\text{-}6}$ is also adapted to communicate via the cellular network 300, as indicated by arrow 310. Moreover, in those embodiments in which the physical distance between the vehicle group 290 and the vehicle group 265 is not close enough to permit direct V2V communication therebetween (e.g., not within range of the ad hoc network 285), the vehicles $\mathbf{105}_{5\text{-}6}$ in the vehicle group 290 may nevertheless be adapted to communicate with one another via their respective communication modules so as to form another ad hoc network (not visible in FIG. 3).

In some embodiments, as in FIG. 3, the system 260 further includes the vehicle $\mathbf{105}_i$, which is neither located in the vicinity of the emergency vehicle 270 nor does it have a route that intersects the route of the emergency vehicle 270. The vehicle $\mathbf{105}_i$ is adapted to communicate via the cellular network 300, as indicated by arrow 315. In some embodiments, as in FIG. 3, the emergency vehicle 270 is also adapted to communicate via the cellular network 300, as indicated by arrow 320. Finally, in some embodiments, as in FIG. 3, the system 260 includes the central server 125, which is adapted to send and receive data to/from the emergency vehicle 270, one more of the vehicles $\mathbf{105}_{1\text{-}4}$ in the vehicle group 265, one or more of the vehicles $\mathbf{105}_{5\text{-}6}$ in the vehicle group 290, and/or the vehicle $\mathbf{105}_i$ via the cellular network 300, the ad hoc network 285, the ad hoc network (not visible in FIG. 3) formed by and between the vehicles $\mathbf{105}_{5\text{-}6}$, or any combination thereof.

Figure 4:
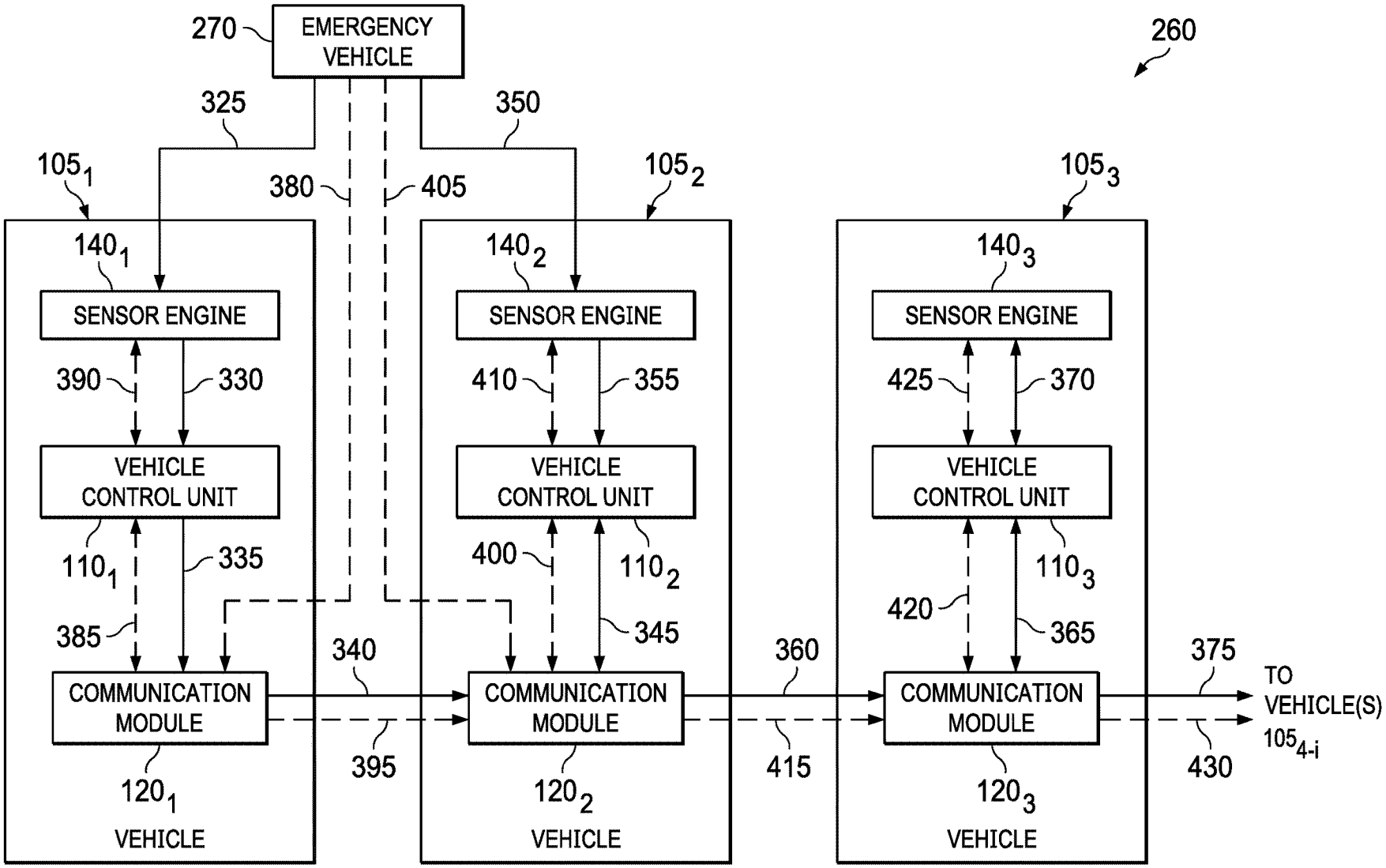
FIG. 4 is a diagrammatic illustration of the emergency vehicle detection, alert, and response system of FIG. 3 in operation, according to one or more embodiments of the present disclosure.

Referring still to FIG. 3, in operation, as it approaches, the emergency vehicle 270 sends the warning signal 275 toward the vehicle group 265. Turning to FIG. 4, with continuing reference to FIG. 3, the vehicles $\mathbf{105}_{1\text{-}i}$ may each include components substantially identical to corresponding components of the vehicle 105, which substantially identical components are referred to by the same reference numerals in FIG. 4, except that a subscript 1, 2, 3, 4, 5, 6, or i is added to each as a suffix. In some embodiments, as in FIG. 4, the warning signal 275 may include visible flashing lights and/or an audible siren. In those embodiments in which the warning signal 275 includes the visible flashing lights and/or the audible siren, the sensor engine $\mathbf{140}_1$ of the vehicle $\mathbf{105}_1$ detects the warning signal 275, as indicated by arrow 325, and sends data based on the warning signal 275 to the vehicle control unit $\mathbf{110}_1$, as indicated by arrow 330. For example, if the warning signal 275 includes the visible flashing lights and/or the audible siren, the vehicle camera(s) and/or the vehicle microphone(s) of the vehicle $\mathbf{105}_1$'s sensor engine $\mathbf{140}_1$ may detect the warning signal 275. In some embodiments, after receiving the data based on the warning signal 275, as indicated by the arrow 330, the vehicle control unit $\mathbf{110}_1$ alerts a driver of the vehicle $\mathbf{105}_1$ visually, audible, or otherwise (e.g., tactile alerts) via the vehicle $\mathbf{105}_1$'s interface engine (shown in FIG. 2) or a portable user device coupled to, and adapted to be in communication with, the vehicle $\mathbf{105}_1$'s interface engine. In at least one such embodiment, the driver alert includes alternate route information to avoid the approaching emergency vehicle 270.

In addition to the data based on the warning signal 275, location data collected from the global positioning system of the sensor engine $\mathbf{140}_1$ may be sent, in combination with the data based on the warning signal 275, from the sensor engine $\mathbf{140}_1$ to the vehicle control unit $\mathbf{110}_1$, as indicated by the arrow 330. The vehicle control unit $\mathbf{110}_1$ receives the combined data from the sensor engine $\mathbf{140}_1$ and executes programming to verify the detection of the warning signal 275 by the sensor engine $\mathbf{140}_1$ and the location of the vehicle $\mathbf{105}_1$ (e.g., before, during or after the detection of the warning signal 275). The vehicle control unit $\mathbf{110}_1$ may also be programmed to determine a location, a direction of travel, a speed, a destination, and/or a route of the emergency vehicle 270 in relation to the vehicle $\mathbf{105}_1$ based on the combined data. After verifying the detection of the warning signal 275 by the sensor engine $\mathbf{140}_1$ and the location of the vehicle $\mathbf{105}_1$, the vehicle control unit $\mathbf{110}_1$ sends data based on the verification to the communication module $\mathbf{120}_1$, as indicated by arrow 335, which communication module $\mathbf{120}_1$, in turn, broadcasts a recognition signal, as indicated by arrow 340. The recognition signal may include, but is not limited to, data relating to: the detection of the warning signal 275 by the sensor engine $\mathbf{140}_1$; the location of the vehicle $\mathbf{105}_1$; and/or the location, the direction of travel, the speed, the destination, and/or the route of the emergency vehicle 270.

The communication module $\mathbf{120}_2$ of the vehicle $\mathbf{105}_2$ receives the recognition signal, as indicated by the arrow 340, and sends data based on the recognition signal to the vehicle control unit $\mathbf{110}_2$, as indicated by arrow 345. The vehicle control unit $\mathbf{110}_2$ receives the data based on the recognition signal from the communication module $120_2$ and executes programming to verify the reception of the recognition signal by the communication module $120_2$. Moreover, in those embodiments in which the warning signal 275 includes the visible flashing lights and/or the audible siren, the sensor engine $140_2$ of the vehicle $105_2$ also detects the warning signal 275, as indicated by arrow 350, in a manner substantially identical to the manner in which the sensor engine $140_1$ of the vehicle $105_1$ detects the warning signal 275, and sends data based on the warning signal 275 to the vehicle control unit $110_2$, as indicated by arrow 355. In some embodiments, after receiving the data based on the recognition signal and/or the data based on the warning signal 275, as indicated by the arrow 355, the vehicle control unit $110_2$ alerts a driver of the vehicle $105_2$ visually, audible, or otherwise (e.g., tactile alerts) via the vehicle $105_2$'s interface engine or a portable user device coupled to, and adapted to be in communication with, the vehicle $105_2$'s interface engine. In at least one such embodiment, the driver alert includes alternate route information to avoid the approaching emergency vehicle 270.

In addition to the data based on the warning signal 275, location data collected from the global positioning system of the sensor engine $140_2$ may be sent, in combination with the data based on the warning signal 275, from the sensor engine $140_2$ to the vehicle control unit $110_2$, as indicated by the arrow 355. The vehicle control unit $110_2$ receives the combined data from the sensor engine $140_2$ and executes programming to verify the detection of the warning signal 275 by the sensor engine $140_2$ and the location of the vehicle $105_2$ (e.g., before, during or after the detection of the warning signal 275). The vehicle control unit $110_2$ may also be programmed to determine a location, a direction of travel, a speed, a destination, and/or a route of the emergency vehicle 270 in relation to the vehicle $105_2$ based on the combined data. After verifying the detection of the warning signal 275 by the sensor engine $140_2$, the location of the vehicle $105_2$, and the reception of the recognition signal by the communication module $120_2$, the vehicle control unit $110_2$ sends data based on the verification back to the communication module $120_2$, as indicated by the arrow 345, which communication module $120_2$, in turn, broadcasts a confirmation signal, as indicated by arrow 360. The confirmation signal may include, but is not limited to, data relating to: the detection of the warning signal 275 by the sensor engine $140_2$; the location of the vehicle $105_2$; the location, the direction of travel, the speed, the destination, and/or the route of the emergency vehicle 270; and/or the recognition signal received from the communication module $120_1$ of the vehicle $105_1$.

The communication module $120_3$ of the vehicle $105_3$ receives the confirmation signal, as indicated by the arrow 360, and sends data based on the confirmation signal to the vehicle control unit $110_3$, as indicated by arrow 365. The vehicle control unit $110_3$ receives the data based on the confirmation signal from the communication module $120_3$ and executes programming to verify the reception of the recognition signal by the communication module $120_3$. In some embodiments, after receiving the data based on the confirmation signal, as indicated by the arrow 365, the vehicle control unit $110_3$ alerts a driver of the vehicle $105_3$ visually, audible, or otherwise (e.g., tactile alerts) via the vehicle $105_3$'s interface engine or a portable user device coupled to, and adapted to be in communication with, the vehicle $105_3$'s interface engine. In at least one such embodiment, the driver alert includes alternate route information to avoid the approaching emergency vehicle 270. Moreover, the vehicle control unit $110_3$ queries location data collected from the global positioning system of the sensor engine $140_3$, as indicated by arrow 370, but the sensor engine $140_3$ does not detect the warning signal 275. Because the sensor engine $140_3$ does not detect the warning signal 275, the vehicle control unit $110_3$ must rely on the data received from the communication module $120_3$ based on the confirmation signal and the location data queried from the sensor engine $140_3$ to determine the location, the direction of travel, the speed, the destination, and/or the route of the emergency vehicle 270 in relation to the vehicle $105_3$.

After verifying the reception of the confirmation signal by the communication module $120_3$, the vehicle control unit $110_3$ sends data based on the verification back to the communication module $120_3$, as indicated by the arrow 365, which communication module $120_3$, in turn, rebroadcasts the confirmation signal, as indicated by arrow 375. The (rebroadcasted) confirmation signal may include, but is not limited to, data relating to: the location of the vehicle $105_3$; the location, the direction of travel, the speed, the destination, and/or the route of the emergency vehicle 270; and/or the confirmation signal received from the communication module $120_2$ of the vehicle $105_2$. This process may continue indefinitely as one or more of the vehicles $105_{4-i}$ receives the (rebroadcasted) confirmation signal, as indicated by the arrow 375, and rebroadcasts the (rebroadcasted) confirmation signal in a manner substantially similar to the manner in which the vehicle $105_3$ rebroadcasts the confirmation signal. The above-described broadcasting (and rebroadcasting) of the confirmation signal may be facilitated by the ad hoc network 285, the cellular network 300, the ad hoc network formed by the vehicle group 290, or any combination thereof. Moreover, the above-described broadcasting of the recognition signal may be facilitated by the ad hoc network 285, the cellular network 300, the ad hoc network formed by the vehicle group 290, or any combination thereof.

In addition to, or instead of, being or including the visible flashing lights and/or the audible siren, the warning signal 275 sent by the emergency vehicle 270 may include an electromagnetic signal (e.g., a radio signal) sent toward the vehicle group 265, which electromagnetic signal may include, for example, data relating to the location, the direction of travel, the speed, the destination, and/or the route of the emergency vehicle 270. In those embodiments in which the warning signal 275 includes the electromagnetic signal, the communication module $120_1$ of the vehicle $105_1$ detects the warning signal 275, as indicated by arrow 380, and sends data based on the warning signal 275 to the vehicle control unit $110_1$, as indicated by arrow 385. In some embodiments, after receiving the data based on the warning signal 275, as indicated by the arrow 385, the vehicle control unit $110_1$ alerts a driver of the vehicle $105_1$ visually, audible, or otherwise (e.g., tactile alerts) via the vehicle $105_1$'s interface engine or a portable user device coupled to, and adapted to be in communication with, the vehicle $105_1$'s interface engine. In at least one such embodiment, the driver alert includes alternate route information to avoid the approaching emergency vehicle 270. In addition to the data based on the warning signal 275, the vehicle control unit $110_1$ may query location data collected from the global positioning system of the sensor engine $140_1$, as indicated by arrow 390. The vehicle control unit $110_1$ receives the data based on the warning signal 275 from the communication module $120_1$ and the location data and/or the route data from the sensor engine $140_1$, and executes programming to verify the reception of the warning signal 275 by the communication module $120_1$ and the location of the vehicle $105_1$. After the reception of the warning signal 275 and the location of the vehicle $\mathbf{105}_1$ are verified by the vehicle control unit $\mathbf{110}_1$, the vehicle control unit $\mathbf{110}_1$ sends data based on the verification back to the communication module $\mathbf{120}_1$, as indicated by the arrow 385, which communication module $\mathbf{120}_1$, in turn, broadcasts a recognition signal, as indicated by arrow 395. The recognition signal may include, but is not limited to, data relating to: the detection of the warning signal 275 by the communication module $\mathbf{120}_1$; the location of the vehicle $\mathbf{105}_1$; and/or the location, the direction of travel, the speed, the destination, and/or the route of the emergency vehicle 270.

The communication module $\mathbf{120}_2$ of the vehicle $\mathbf{105}_2$ receives the recognition signal, as indicated by the arrow 395, and sends data based on the recognition signal to the vehicle control unit $\mathbf{110}_2$, as indicated by arrow 400. The vehicle control unit $\mathbf{110}_2$ receives the data based on the recognition signal from the communication module $\mathbf{120}_2$ and executes programming to verify the reception of the recognition signal by the communication module $\mathbf{120}_2$. Moreover, in those embodiments in which the warning signal 275 includes the electromagnetic signal, the communication module $\mathbf{120}_2$ of the vehicle $\mathbf{105}_2$ detects the warning signal 275, as indicated by arrow 405, in a manner substantially identical to the manner in which the communication module $\mathbf{120}_1$ of the vehicle $\mathbf{105}_1$ detects the warning signal 275, and sends data based on the warning signal 275 to the vehicle control unit $\mathbf{110}_2$, as indicated by the arrow 400. In some embodiments, after receiving the data based on the recognition signal and/or the data based on the warning signal 275, as indicated by the arrow 400, the vehicle control unit $\mathbf{110}_2$ alerts a driver of the vehicle $\mathbf{105}_2$ visually, audible, or otherwise (e.g., tactile alerts) via the vehicle $\mathbf{105}_2$'s interface engine or a portable user device coupled to, and adapted to be in communication with, the vehicle $\mathbf{105}_2$'s interface engine. In at least one such embodiment, the driver alert includes alternate route information to avoid the approaching emergency vehicle 270. In addition to the data based on the warning signal 275, the vehicle control unit $\mathbf{110}_2$ may query location data collected from the global positioning system of the sensor engine $\mathbf{140}_2$, as indicated by arrow 410.

The vehicle control unit $\mathbf{110}_2$ receives the data based on the recognition signal from the communication module $\mathbf{120}_2$, the data based on the warning signal 275 from the communication module $\mathbf{120}_2$, and the location data and/or the route data from the sensor engine $\mathbf{140}_2$, and executes programming to verify the reception of the recognition signal, the reception of the warning signal 275, and the location of the vehicle $\mathbf{105}_2$. After the reception of the recognition signal, the reception of the warning signal 275, and the location of the vehicle $\mathbf{105}_2$ are verified by the vehicle control unit $\mathbf{110}_2$, the vehicle control unit $\mathbf{110}_2$ sends data based on the verification back to the communication module $\mathbf{120}_2$, as indicated by the arrow 400, which communication module $\mathbf{120}_2$, in turn, broadcasts a confirmation signal, as indicated by arrow 415. The confirmation signal may include, but is not limited to, data relating to: the detection of the warning signal 275 by the communication module $\mathbf{120}_2$; the location of the vehicle $\mathbf{105}_2$; the location, the direction of travel, the speed, the destination, and/or the route of the emergency vehicle 270; and/or the recognition signal received from the communication module $\mathbf{120}_1$ of the vehicle $\mathbf{105}_1$.

The communication module $\mathbf{120}_3$ of the vehicle $\mathbf{105}_3$ receives the confirmation signal, as indicated by the arrow 415, and sends data based on the confirmation signal to the vehicle control unit $\mathbf{110}_3$, as indicated by arrow 420, but the communication module $\mathbf{120}_3$ does not detect the warning signal 275. In some embodiments, after receiving the data based on the confirmation signal, as indicated by the arrow 420, the vehicle control unit $\mathbf{110}_3$ alerts a driver of the vehicle $\mathbf{105}_3$ visually, audible, or otherwise (e.g., tactile alerts) via the vehicle $\mathbf{105}_3$'s interface engine or a portable user device coupled to, and adapted to be in communication with, the vehicle $\mathbf{105}_3$'s interface engine. In at least one such embodiment, the driver alert includes alternate route information to avoid the approaching emergency vehicle 270. In addition to the data based on the confirmation signal, the vehicle control unit $\mathbf{110}_3$ may query location data collected from the global positioning system of the sensor engine $\mathbf{140}_3$, as indicated by arrow 425. The vehicle control unit $\mathbf{110}_3$ receives the data based on the confirmation signal from the communication module $\mathbf{120}_3$ and the location data and/or the route data from the sensor engine $\mathbf{140}_3$, and executes programming to verify the reception of the confirmation signal by the communication module $\mathbf{120}_3$ and the location and/or the route of the vehicle $\mathbf{105}_3$. After the reception of the confirmation signal and the location and/or the route of the vehicle $\mathbf{105}_3$ are verified by the vehicle control unit $\mathbf{110}_3$, the vehicle control unit $\mathbf{110}_3$ sends data based on the verification back to the communication module $\mathbf{120}_3$, as indicated by the arrow 420, which communication module $\mathbf{120}_3$, in turn, rebroadcasts the confirmation signal, as indicated by arrow 430. The rebroadcasted confirmation signal may include, but is not limited to, data relating to the location and/or the route of the vehicle $\mathbf{105}_3$, and/or data relating to the confirmation signal received from the vehicle $\mathbf{105}_2$.

The (rebroadcasted) confirmation signal may include, but is not limited to, data relating to: the location of the vehicle $\mathbf{105}_3$; the location, the direction of travel, the speed, the destination, and/or the route of the emergency vehicle 270; and/or the confirmation signal received from the communication module $\mathbf{120}_2$ of the vehicle $\mathbf{105}_2$. This process may continue indefinitely as one or more of the vehicles $\mathbf{105}_{4-i}$ receives the (rebroadcasted) confirmation signal, as indicated by the arrow 430, and rebroadcasts the (rebroadcasted) confirmation signal in a manner substantially similar to the manner in which the vehicle $\mathbf{105}_3$ rebroadcasts the confirmation signal. The above-described broadcasting (and rebroadcasting) of the confirmation signal may be facilitated by the ad hoc network 285, the cellular network 300, the ad hoc network formed by the vehicle group 290, or any combination thereof. Moreover, the above-described broadcasting of the recognition signal may be facilitated by the ad hoc network 285, the cellular network 300, the ad hoc network formed by the vehicle group 290, or any combination thereof.

Figure 5:
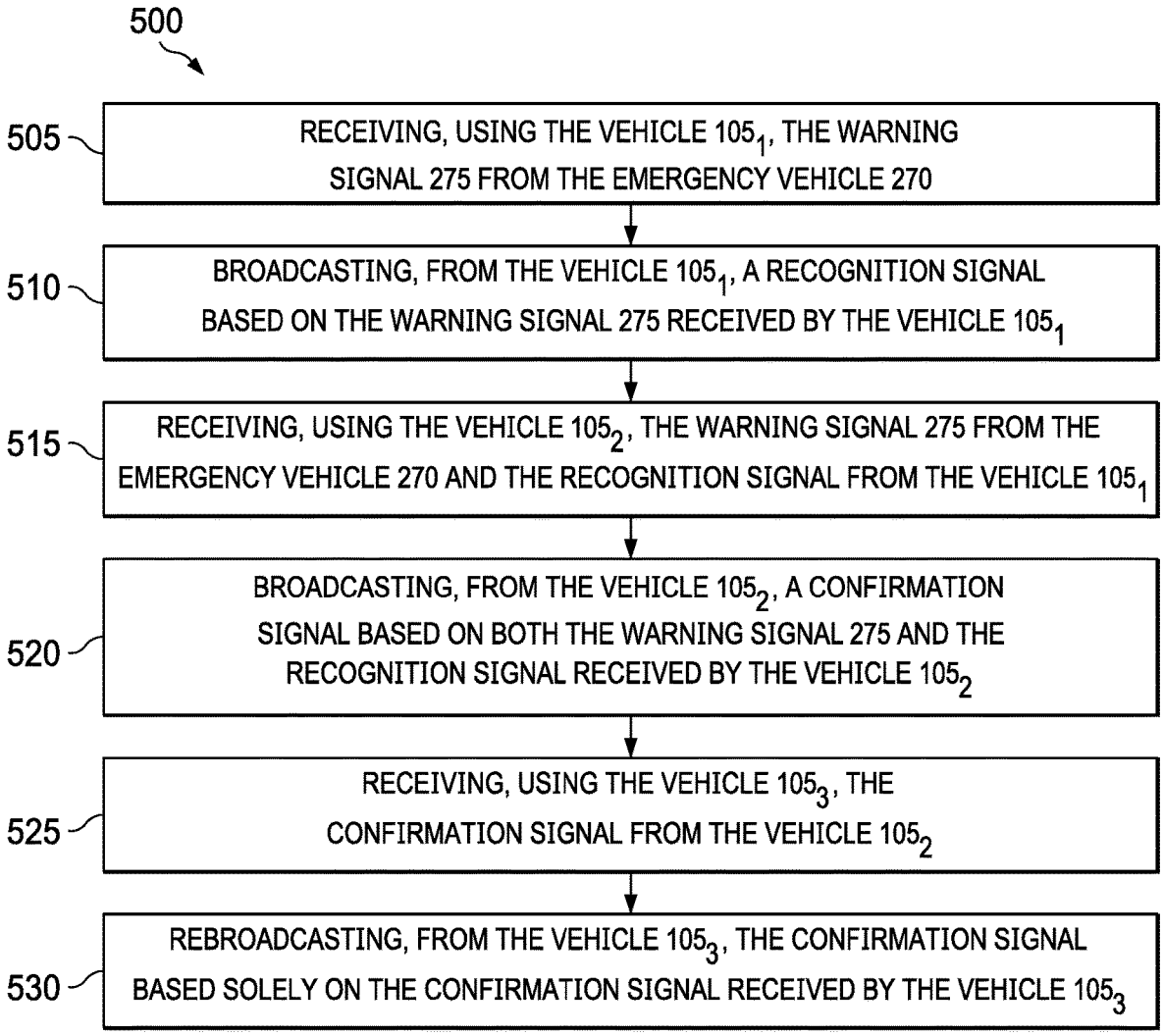
FIG. 5 is a flow diagram of a method for implementing one or more embodiments of the present disclosure.

Referring to FIG. 5, in an embodiment, a method of operating the system 260 is generally referred to by the reference numeral 500. The method 500 is executed in response to the emergency vehicle 270 sending the warning signal 275 toward the vehicle group as it approaches. The method 500 includes at a step 505, receiving, using the vehicle $\mathbf{105}_1$, the warning signal 275 from the emergency vehicle 270. In some embodiments, the method 500 further includes communicating a first alert regarding the emergency vehicle 270 to a driver of the vehicle $\mathbf{105}_1$ based on the warning signal 275 received by the vehicle $\mathbf{105}_1$, the first alert including data relating to a location, a direction of travel, a speed, a destination, and/or a route of the emergency vehicle 270.

At a step 510, a recognition signal is broadcast from the vehicle $\mathbf{105}_1$ based on the warning signal 275 received by the vehicle $105_1$. In some embodiments of the step 510, the recognition signal includes data relating to the warning signal 275 received by the vehicle $105_1$, and at least one of: a location, a direction of travel, a speed, a destination, and/or a route of the emergency vehicle 270; and a location, a direction of travel, a speed, a destination, and/or a route of the vehicle $105_1$.

At a step 515, using the vehicle $105_2$, the warning signal 275 is received from the emergency vehicle 270 and the recognition signal is received from the vehicle $105_1$. In some embodiments, the method 500 further includes communicating a second alert regarding the emergency vehicle 270 to a driver of the vehicle $105_2$ based on the warning signal 275 received by the vehicle $105_2$, the second alert including data relating to the location, the direction of travel, the speed, the destination, and/or the route of the emergency vehicle 270.

At a step 520, a confirmation signal is broadcast from the vehicle $105_2$ based on both the warning signal 275 and the recognition signal received by the vehicle $105_2$. In some embodiments of the step 520, the confirmation signal includes data relating to the warning signal 275 received by the vehicle $105_2$, the recognition signal received by the vehicle $105_2$, and at least one of: a location, a direction of travel, a speed, a destination, and/or a route of the emergency vehicle 270; and a location, a direction of travel, a speed, a destination, and/or a route of the vehicle $105_2$.

At a step 525, using the vehicle $105_3$, the confirmation signal is received from the vehicle $105_2$. In some embodiments, the method 500 further includes communicating a third alert regarding the emergency vehicle 270 to a driver of the vehicle $105_3$ based on the confirmation signal received by the vehicle $105_3$, the third alert including data relating to the location, the direction of travel, the speed, the destination, and/or the route of the emergency vehicle 270.

At a step 530, the confirmation signal is rebroadcasted from the vehicle $105_3$ based solely on the confirmation signal received by the vehicle $105_3$.

In some embodiments of the method 500, the warning signal 275 includes visible flashing lights and/or an audible siren; receiving, using the vehicle $105_1$, the warning signal 275 from the emergency vehicle 270 includes detecting the visible flashing lights and/or the audible siren using the camera and/or the microphone of the vehicle $105_1$; and receiving, using the vehicle $105_2$, the warning signal 275 from the emergency vehicle 270 and the recognition signal from the vehicle $105_1$ includes: detecting the visible flashing lights and/or the audible siren using the camera and/or the microphone of the vehicle $105_2$, and receiving the recognition signal using the communication module $120_2$ of the vehicle $105_2$.

In some embodiments of the method 500, the warning signal 275 is an electromagnetic signal including data relating to a location, a direction of travel, a speed, a destination, and/or a route of the emergency vehicle 270; receiving, using the vehicle $105_1$, the warning signal 275 from the emergency vehicle 270 includes receiving the electromagnetic signal using the communication module $120_1$ of the vehicle $105_1$; and receiving, using the vehicle $105_2$, the warning signal 275 from the emergency vehicle 270 and the recognition signal from the vehicle $105_1$ includes: receiving the electromagnetic signal using the communication module $120_2$ of the vehicle $105_2$, and receiving the recognition signal using the communication module $120_2$ of the vehicle $105_2$.

In some embodiments, the operation of the system 260 and/or the execution of the method 500 provides a longer warning period for vehicle drivers to react accordingly to an approaching emergency vehicle by, for example, pulling his or her vehicle to the side of the road to clear a path for the emergency vehicle to pass. Furthermore, although only the vehicles $105_1$ and $105_2$ are described in connection with the system 260 and the method 500 as receiving the warning signal 275 from the emergency vehicle 270, any one of the vehicles $105_{3-i}$ may also receive the warning signal 275. In various embodiments, a confidence score may be assigned to the confirmation signal based on the number of the vehicles $105_{1-i}$ that detect the warning signal 275, with a higher confidence score equating to a greater number of the vehicles $105_{1-i}$ actually receiving the warning signal 275, as opposed to merely rebroadcasting the confirmation signal.

Figure 6:
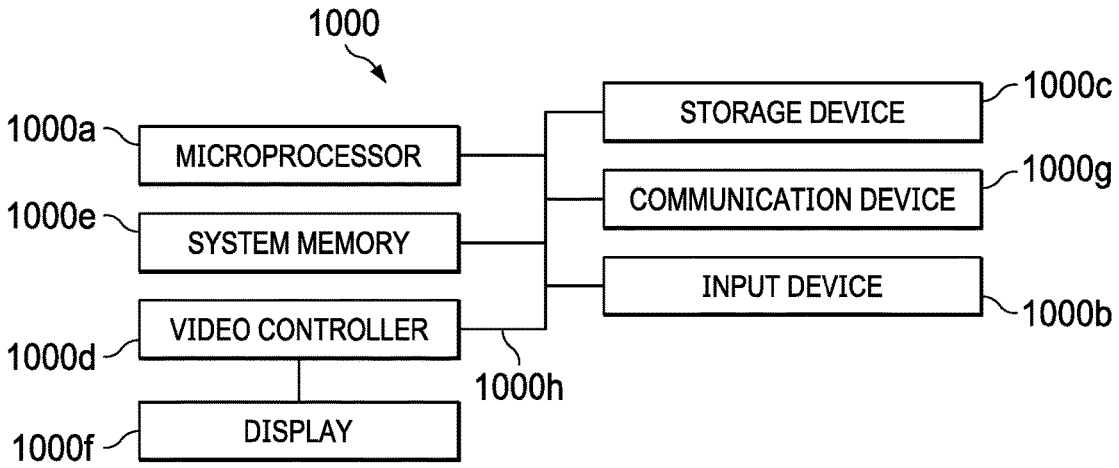
FIG. 6 is a diagrammatic illustration of a computing node for implementing one or more embodiments of the present disclosure.

Referring to FIG. 6, in an embodiment, a computing node 1000 for implementing one or more embodiments of one or more of the above-described elements, control units (e.g., $110_{1-i}$) systems (e.g., 100 and/or 260), methods (e.g., 500) and/or steps (e.g., 505, 510, 515, 520, 525, and/or 530), or any combination thereof, is depicted. The node 1000 includes a microprocessor 1000*a*, an input device 1000*b*, a storage device 1000*c*, a video controller 1000*d*, a system memory 1000*e*, a display 1000*f*, and a communication device 1000*g* all interconnected by one or more buses 1000*h*. In several embodiments, the storage device 1000*c* may include a floppy drive, hard drive, CD-ROM, optical drive, any other form of storage device or any combination thereof. In several embodiments, the storage device 1000*c* may include, and/or be capable of receiving, a floppy disk, CD-ROM, DVD-ROM, or any other form of computer-readable medium that may contain executable instructions. In several embodiments, the communication device 1000*g* may include a modem, network card, or any other device to enable the node 1000 to communicate with other nodes. In several embodiments, any node represents a plurality of interconnected (whether by intranet or Internet) computer systems, including without limitation, personal computers, mainframes, PDAs, smartphones and cell phones.

In several embodiments, one or more of the components of any of the above-described systems include at least the node 1000 and/or components thereof, and/or one or more nodes that are substantially similar to the node 1000 and/or components thereof. In several embodiments, one or more of the above-described components of the node 1000 and/or the above-described systems include respective pluralities of same components.

In several embodiments, a computer system typically includes at least hardware capable of executing machine readable instructions, as well as the software for executing acts (typically machine-readable instructions) that produce a desired result. In several embodiments, a computer system may include hybrids of hardware and software, as well as computer sub-systems.

In several embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In several embodiments, hardware may include any physical device that is capable of storing machine-readable instructions, such as memory or other data storage devices. In several embodiments, other forms of hardware include hardware sub-systems, including transfer devices such as modems, modem cards, ports, and port cards, for example.

In several embodiments, software includes any machine code stored in any memory medium, such as RAM or ROM, and machine code stored on other devices (such as floppy disks, flash memory, or a CD ROM, for example). In several embodiments, software may include source or object code. In several embodiments, software encompasses any set of instructions capable of being executed on a node such as, for example, on a client machine or server.

In several embodiments, combinations of software and hardware could also be used for providing enhanced functionality and performance for certain embodiments of the present disclosure. In an embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In several embodiments, computer readable mediums include, for example, passive data storage, such as a random access memory (RAM) as well as semi-permanent data storage such as a compact disk read only memory (CD-ROM). One or more embodiments of the present disclosure may be embodied in the RAM of a computer to transform a standard computer into a new specific computing machine. In several embodiments, data structures are defined organizations of data that may enable an embodiment of the present disclosure. In an embodiment, data structure may provide an organization of data, or an organization of executable code.

In several embodiments, any networks and/or one or more portions thereof, may be designed to work on any specific architecture. In an embodiment, one or more portions of any networks may be executed on a single computer, local area networks, client-server networks, wide area networks, internets, hand-held and other portable and wireless devices and networks.

In several embodiments, database may be any standard or proprietary database software. In several embodiments, the database may have fields, records, data, and other database elements that may be associated through database specific software. In several embodiments, data may be mapped. In several embodiments, mapping is the process of associating one data entry with another data entry. In an embodiment, the data contained in the location of a character file can be mapped to a field in a second table. In several embodiments, the physical location of the database is not limiting, and the database may be distributed. In an embodiment, the database may exist remotely from the server, and run on a separate platform. In an embodiment, the database may be accessible across the Internet. In several embodiments, more than one database may be implemented.

In several embodiments, a plurality of instructions stored on a computer readable medium may be executed by one or more processors to cause the one or more processors to carry out or implement in whole or in part the above-described operation of each of the above-described elements, control units (e.g., $\mathbf{110}_{1\text{-}i}$) systems (e.g., 100 and/or 260), methods (e.g., 500) and/or steps (e.g., 505, 510, 515, 520, 525, and/or 530), and/or any combination thereof. In several embodiments, such a processor may include one or more of the microprocessor 1000*a*, any processor(s) that are part of the components of the above-described systems, and/or any combination thereof, and such a computer readable medium may be distributed among one or more components of the above-described systems. In several embodiments, such a processor may execute the plurality of instructions in connection with a virtual computer system. In several embodiments, such a plurality of instructions may communicate directly with the one or more processors, and/or may interact with one or more operating systems, middleware, firmware, other applications, and/or any combination thereof, to cause the one or more processors to execute the instructions.

A method has been disclosed. The method generally includes receiving, using a first vehicle, a warning signal from an emergency vehicle; broadcasting, from the first vehicle, a recognition signal based on the warning signal received by the first vehicle; receiving, using a second vehicle, the warning signal from the emergency vehicle and the recognition signal from the first vehicle; and broadcasting, from the second vehicle, a confirmation signal based on both the warning signal and the recognition signal received by the second vehicle.

The foregoing method embodiment may include one or more of the following elements, either alone or in combination with one another:

- The recognition signal includes data relating to: the warning signal received by the first vehicle; and at least one of: a location, a direction of travel, a speed, a destination, and/or a route of the emergency vehicle; and a location, a direction of travel, a speed, a destination, and/or a route of the first vehicle.
- The confirmation signal includes data relating to: the warning signal received by the second vehicle; the recognition signal received by the second vehicle; and at least one of: a location, a direction of travel, a speed, a destination, and/or a route of the emergency vehicle; and a location, a direction of travel, a speed, a destination, and/or a route of the second vehicle.
- The method further includes receiving, using a third vehicle, the confirmation signal from the second vehicle; and rebroadcasting, from the third vehicle, the confirmation signal based solely on the confirmation signal received by the third vehicle.
- The method further includes at least one of: communicating a first alert regarding the emergency vehicle to a driver of the first vehicle based the warning signal received by the first vehicle, the first alert including data relating to a location, a direction of travel, a speed, a destination, and/or a route of the emergency vehicle; communicating a second alert regarding the emergency vehicle to a driver of the second vehicle based on the warning signal received by the second vehicle, the second alert including data relating to the location, the direction of travel, the speed, the destination, and/or the route of the emergency vehicle; and communicating a third alert regarding the emergency vehicle to a driver of the third vehicle based on the confirmation signal received by the third vehicle, the third alert including data relating to the location, the direction of travel, the speed, the destination, and/or the route of the emergency vehicle.
- The warning signal includes visible flashing lights and/or an audible siren; wherein receiving, using the first vehicle, the warning signal from the emergency vehicle includes detecting the visible flashing lights and/or the audible siren using a camera and/or a microphone of the first vehicle; and wherein receiving, using the second vehicle, the warning signal from the emergency vehicle and the recognition signal from the first vehicle includes: detecting the visible flashing lights and/or the audible siren using a camera and/or a microphone of the second vehicle; and receiving the recognition signal using a communication module of the second vehicle.
- The warning signal is an electromagnetic signal including data relating to a location, a direction of travel, a speed, a destination, and/or a route of the emergency vehicle;

wherein receiving, using the first vehicle, the warning signal from the emergency vehicle includes receiving the electromagnetic signal using a communication module of the first vehicle; and wherein receiving, using the second vehicle, the warning signal from the emergency vehicle and the recognition signal from the first vehicle includes: receiving the electromagnetic signal using a communication module of the second vehicle; and receiving the recognition signal using the communication module of the second vehicle.

A system has also been disclosed. The system generally includes an emergency vehicle adapted to broadcast a warning signal; a first vehicle adapted to receive the warning signal from the emergency vehicle, wherein the first vehicle is further adapted to broadcast a recognition signal based on the warning signal received by the first vehicle; and a second vehicle adapted to receive the warning signal from the emergency vehicle and the recognition signal from the first vehicle, wherein the second vehicle is further adapted to broadcast a confirmation signal based both on the warning signal and the recognition signal received by the second vehicle.

The foregoing system embodiment may include one or more of the following elements, either alone or in combination with one another:

The recognition signal includes data relating to: the warning signal received by the first vehicle; and at least one of: a location, a direction of travel, a speed, a destination, and/or a route of the emergency vehicle; and a location, a direction of travel, a speed, a destination, and/or a route of the first vehicle.

The confirmation signal includes data relating to: the warning signal received by the second vehicle; the recognition signal received by the second vehicle; and at least one of: a location, a direction of travel, a speed, a destination, and/or a route of the emergency vehicle; and a location, a direction of travel, a speed, a destination, and/or a route of the second vehicle.

The system further includes a third vehicle adapted to receive the confirmation signal from the second vehicle, wherein the third vehicle is further adapted to rebroadcast the confirmation signal based solely on the confirmation signal received by the third vehicle.

The warning signal includes visible flashing lights and/or an audible siren; wherein the first vehicle is adapted to receive the warning signal from the emergency vehicle by detecting the visible flashing lights and/or the audible siren using a camera and/or a microphone of the first vehicle; and wherein the second vehicle is adapted to receive the warning signal from the emergency vehicle and the recognition signal from the first vehicle by: detecting the visible flashing lights and/or the audible siren using a camera and/or a microphone of the second vehicle; and receiving the recognition signal using a communication module of the second vehicle.

The warning signal is an electromagnetic signal including data relating to a location, a direction of travel, a speed, a destination, and/or a route of the emergency vehicle; wherein the first vehicle is adapted to receive the warning signal from the emergency vehicle by receiving the electromagnetic signal using a communication module of the first vehicle; and wherein the second vehicle is adapted to receive the warning signal from the emergency vehicle and the recognition signal from the first vehicle by: receiving the electromagnetic signal using a communication module of the second vehicle; and receiving the recognition signal using the communication module of the second vehicle.

An apparatus has also been disclosed. The apparatus generally includes a non-transitory computer readable medium; and a plurality of instructions stored on the non-transitory computer readable medium and executable by one or more processors, the plurality of instructions including: instructions that, when executed, cause the one or more processors to receive, using a first vehicle, a warning signal from an emergency vehicle; instructions that, when executed, cause the one or more processors to broadcast, from the first vehicle, a recognition signal based on the warning signal received by the first vehicle; instructions that, when executed, cause the one or more processors to receive, using a second vehicle, the warning signal from the emergency vehicle and the recognition signal from the first vehicle; and instructions that, when executed, cause the one or more processors to broadcast, from the second vehicle, a confirmation signal based on both the warning signal and the recognition signal received by the second vehicle.

The foregoing apparatus embodiment may include one or more of the following elements, either alone or in combination with one another:

The recognition signal includes data relating to: the warning signal received by the first vehicle; and at least one of: a location, a direction of travel, a speed, a destination, and/or a route of the emergency vehicle; and a location, a direction of travel, a speed, a destination, and/or a route of the first vehicle.

The confirmation signal includes data relating to: the warning signal received by the second vehicle; the recognition signal received by the second vehicle; and at least one of: a location, a direction of travel, a speed, a destination, and/or a route of the emergency vehicle; and a location, a direction of travel, a speed, a destination, and/or a route of the second vehicle.

The plurality of instructions further include: instructions that, when executed, cause the one or more processors to receive, using a third vehicle, the confirmation signal from the second vehicle; and instructions that, when executed, cause the one or more processors to rebroadcast, from the third vehicle, the confirmation signal based solely on the confirmation signal received by the third vehicle.

The plurality of instructions further include at least one of: instructions that, when executed, cause the one or more processors to communicate a first alert regarding the emergency vehicle to a driver of the first vehicle based on the warning signal received by the first vehicle, the first alert including data relating to a location, a direction of travel, a speed, a destination, and/or a route of the emergency vehicle; instructions that, when executed, cause the one or more processors to communicate a second alert regarding the emergency vehicle to a driver of the second vehicle based on the warning signal received by the second vehicle, the second alert including data relating to the location, the direction of travel, the speed, the destination, and/or the route of the emergency vehicle; and instructions that, when executed, cause the one or more processors to communicate a third alert regarding the emergency vehicle to a driver of the third vehicle based on the confirmation signal received by the third vehicle, the third alert including data relating to the location, the direction of travel, the speed, the destination, and/or the route of the emergency vehicle.

The warning signal includes visible flashing lights and/or an audible siren; wherein the instructions that, when executed, cause the one or more processors to receive, using the first vehicle, the warning signal from the emergency vehicle includes instructions that, when executed, cause the one or more processors to detect the visual flashing lights and/or the audible siren using a camera and/or a microphone of the first vehicle; and wherein the instructions that, when executed, cause the one or more processors to receive, using the second vehicle, the warning signal from the emergency vehicle and the recognition signal from the first vehicle include: instructions that, when executed, cause the one or more processors to detect the visual flashing lights and/or the audible siren using a camera and/or a microphone of the second vehicle; and instructions that, when executed, cause the one or more processors to receive the recognition signal using a communication module of the second vehicle.

The warning signal is an electromagnetic signal including data relating to a location, a direction of travel, a speed, a destination, and/or a route of the emergency vehicle; wherein the instructions that, when executed, cause the one or more processors to receive, using the first vehicle, the warning signal from the emergency vehicle include instructions that, when executed, cause the one or more processors to receive the electromagnetic signal using a communication module of the first vehicle; and wherein the instructions that, when executed, cause the one or more processors to receive, using the second vehicle, the warning signal from the emergency vehicle and the recognition signal from the first vehicle include: instructions that, when executed, cause the one or more processors to receive the electromagnetic signal using a communication module of the second vehicle; and instructions that, when executed, cause the one or more processors to receive the recognition signal using the communication module of the second vehicle.

It is understood that variations may be made in the foregoing without departing from the scope of the present disclosure.

In some embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In some embodiments, while different steps, processes, and procedures are described as appearing as distinct acts, one or more of the steps, one or more of the processes, and/or one or more of the procedures may also be performed in different orders, simultaneously and/or sequentially. In some embodiments, the steps, processes, and/or procedures may be merged into one or more steps, processes and/or procedures.

In some embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although some embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims.

What is claimed is:

1. A method, comprising:

receiving, using a first vehicle, a first warning signal from an emergency vehicle;

broadcasting, from the first vehicle, a recognition signal based on the first warning signal received by the first vehicle from the emergency vehicle;

receiving, using a second vehicle, a second warning signal from the emergency vehicle;

receiving, using the second vehicle, the recognition signal from the first vehicle;

broadcasting, from the second vehicle, a confirmation signal based on both:

the second warning signal received by the second vehicle from the emergency vehicle; and the recognition signal received by the second vehicle from the first vehicle;

receiving, using a third vehicle, the confirmation signal from the second vehicle; and rebroadcasting, from the third vehicle, the confirmation signal based solely on the confirmation signal received by the third vehicle from the second vehicle.

2. The method of claim 1, wherein the recognition signal includes data relating to:

the first warning signal received by the first vehicle from the emergency vehicle; and at least one of:

a location, a direction of travel, a speed, a destination, and/or a route of the emergency vehicle; and a location, a direction of travel, a speed, a destination, and/or a route of the first vehicle.

3. The method of claim 1, wherein the confirmation signal includes data relating to:

the second warning signal received by the second vehicle from the emergency vehicle;

the recognition signal received by the second vehicle from the first vehicle; and at least one of:

a location, a direction of travel, a speed, a destination, and/or a route of the emergency vehicle; and a location, a direction of travel, a speed, a destination, and/or a route of the second vehicle.

4. The method of claim 1, further comprising at least one of:

communicating a first alert regarding the emergency vehicle to a driver of the first vehicle based on the first warning signal received by the first vehicle from the emergency vehicle, the first alert including data relating to a location, a direction of travel, a speed, a destination, and/or a route of the emergency vehicle;

communicating a second alert regarding the emergency vehicle to a driver of the second vehicle based on the second warning signal received by the second vehicle from the emergency vehicle, the second alert including data relating to the location, the direction of travel, the speed, the destination, and/or the route of the emergency vehicle; and communicating a third alert regarding the emergency vehicle to a driver of the third vehicle based on the confirmation signal received by the third vehicle from the second vehicle, the third alert including data relating to the location, the direction of travel, the speed, the destination, and/or the route of the emergency vehicle.

5. The method of claim 1, wherein the first warning signal and the second warning signal include visible flashing lights and/or an audible siren;

wherein receiving, using the first vehicle, the first warning signal from the emergency vehicle comprises detecting the visible flashing lights and/or the audible siren using a camera and/or a microphone of the first vehicle; and wherein receiving, using the second vehicle, the second warning signal from the emergency vehicle and the recognition signal from the first vehicle comprises:

detecting the visible flashing lights and/or the audible siren from the emergency vehicle using a camera and/or a microphone of the second vehicle; and receiving the recognition signal from the first vehicle using a communication module of the second vehicle.

6. The method of claim 1, wherein the first warning signal and the second warning signal include electromagnetic signals including data relating to a location, a direction of travel, a speed, a destination, and/or a route of the emergency vehicle;

wherein receiving, using the first vehicle, the first warning signal from the emergency vehicle comprises receiving the electromagnetic signal using a communication module of the first vehicle; and wherein receiving, using the second vehicle, the second warning signal from the emergency vehicle and the recognition signal from the first vehicle comprises:

receiving the electromagnetic signal from the emergency vehicle using a communication module of the second vehicle; and receiving the recognition signal from the first vehicle using the communication module of the second vehicle.

7. A system, comprising:

an emergency vehicle adapted to broadcast first and second warning signals;

a first vehicle adapted to receive the first warning signal from the emergency vehicle, wherein the first vehicle is further adapted to broadcast a recognition signal based on the first warning signal received by the first vehicle from the emergency vehicle;

a second vehicle adapted to receive the second warning signal from the emergency vehicle and the recognition signal from the first vehicle, wherein the second vehicle is further adapted to broadcast a confirmation signal based on both:

the second warning signal received by the second vehicle from the emergency vehicle; and the recognition signal received by the second vehicle from the first vehicle:

and a third vehicle adapted to receive the confirmation signal from the second vehicle, wherein the third vehicle is further adapted to rebroadcast the confirmation signal based solely on the confirmation signal received by the third vehicle from the second vehicle.

8. The system of claim 7, wherein the recognition signal includes data relating to:

the first warning signal received by the first vehicle from the emergency vehicle; and at least one of:

a location, a direction of travel, a speed, a destination, and/or a route of the emergency vehicle; and a location, a direction of travel, a speed, a destination, and/or a route of the first vehicle.

9. The system of claim 7, wherein the confirmation signal includes data relating to:

the second warning signal received by the second vehicle from the emergency vehicle;

the recognition signal received by the second vehicle from the first vehicle; and at least one of:

a location, a direction of travel, a speed, a destination, and/or a route of the emergency vehicle; and a location, a direction of travel, a speed, a destination, and/or a route of the second vehicle.

10. The system of claim 7, wherein the first warning signal and the second warning signal include visible flashing lights and/or an audible siren;

wherein the first vehicle is adapted to receive the first warning signal from the emergency vehicle by detecting the visible flashing lights and/or the audible siren using a camera and/or a microphone of the first vehicle; and wherein the second vehicle is adapted to receive the second warning signal from the emergency vehicle and the recognition signal from the first vehicle by:

detecting the visible flashing lights and/or the audible siren from the emergency vehicle using a camera and/or a microphone of the second vehicle; and receiving the recognition signal from the first vehicle using a communication module of the second vehicle.

11. The system of claim 7, wherein the first warning signal and the second warning signal include electromagnetic signals including data relating to a location, a direction of travel, a speed, a destination, and/or a route of the emergency vehicle;

wherein the first vehicle is adapted to receive the first warning signal from the emergency vehicle by receiving the electromagnetic signal using a communication module of the first vehicle; and wherein the second vehicle is adapted to receive the second warning signal from the emergency vehicle and the recognition signal from the first vehicle by:

receiving the electromagnetic signal from the emergency vehicle using a communication module of the second vehicle; and receiving the recognition signal from the first vehicle using the communication module of the second vehicle.

12. An apparatus, comprising:

a non-transitory computer readable medium; and a plurality of instructions stored on the non-transitory computer readable medium and executable by one or more processors, the plurality of instructions comprising:

instructions that, when executed, cause the one or more processors to receive, using a first vehicle, a first warning signal from an emergency vehicle;

instructions that, when executed, cause the one or more processors to broadcast, from the first vehicle, a recognition signal based on the first warning signal received by the first vehicle from the emergency vehicle;

instructions that, when executed, cause the one or more processors to receive, using a second vehicle, a second warning signal from the emergency vehicle;

instructions that, when executed, cause the one or more processors to receive, using the second vehicle, the recognition signal from the first vehicle;

instructions that, when executed, cause the one or more processors to broadcast, from the second vehicle, a confirmation signal based on both:

the second warning signal received by the second vehicle from the emergency vehicle; and the recognition signal received by the second vehicle from the first vehicle;

instructions that, when executed, cause the one or more processors to receive, using a third vehicle, the confirmation signal from the second vehicle; and instructions that, when executed, cause the one or more processors to rebroadcast, from the third vehicle, the confirmation signal based solely on the confirmation signal received by the third vehicle from the second vehicle.

13. The apparatus of claim 12, wherein the recognition signal includes data relating to:

the first warning signal received by the first vehicle from the emergency vehicle; and at least one of:

a location, a direction of travel, a speed, a destination, and/or a route of the emergency vehicle; and a location, a direction of travel, a speed, a destination, and/or a route of the first vehicle.

14. The apparatus of claim 12, wherein the confirmation signal includes data relating to:

the second warning signal received by the second vehicle from the emergency vehicle;

the recognition signal received by the second vehicle from the first vehicle; and at least one of:

a location, a direction of travel, a speed, a destination, and/or a route of the emergency vehicle; and a location, a direction of travel, a speed, a destination, and/or a route of the second vehicle.

15. The apparatus of claim 12, wherein the plurality of instructions further comprise at least one of:

instructions that, when executed, cause the one or more processors to communicate a first alert regarding the emergency vehicle to a driver of the first vehicle based on the first warning signal received by the first vehicle from the emergency vehicle, the first alert including data relating to a location, a direction of travel, a speed, a destination, and/or a route of the emergency vehicle;

instructions that, when executed, cause the one or more processors to communicate a second alert regarding the emergency vehicle to a driver of the second vehicle based on the second warning signal received by the second vehicle from the emergency vehicle, the second alert including data relating to the location, the direction of travel, the speed, the destination, and/or the route of the emergency vehicle; and instructions that, when executed, cause the one or more processors to communicate a third alert regarding the emergency vehicle to a driver of the third vehicle based on the confirmation signal received by the third vehicle from the second vehicle, the third alert including data relating to the location, the direction of travel, the speed, the destination, and/or the route of the emergency vehicle.

16. The apparatus of claim 12, wherein the first warning signal and the second warning signal include visible flashing lights and/or an audible siren;

wherein the instructions that, when executed, cause the one or more processors to receive, using the first vehicle, the first warning signal from the emergency vehicle comprises instructions that, when executed, cause the one or more processors to detect the visual flashing lights and/or the audible siren using a camera and/or a microphone of the first vehicle; and wherein the instructions that, when executed, cause the one or more processors to receive, using the second vehicle, the second warning signal from the emergency vehicle and the recognition signal from the first vehicle comprise:

instructions that, when executed, cause the one or more processors to detect the visual flashing lights and/or the audible siren from the emergency vehicle using a camera and/or a microphone of the second vehicle; and instructions that, when executed, cause the one or more processors to receive the recognition signal from the first vehicle using a communication module of the second vehicle.

17. The apparatus of claim 12, wherein the first warning signal and the second warning signal include electromagnetic signals including data relating to a location, a direction of travel, a speed, a destination, and/or a route of the emergency vehicle;

wherein the instructions that, when executed, cause the one or more processors to receive, using the first vehicle, the first warning signal from the emergency vehicle comprise instructions that, when executed, cause the one or more processors to receive the electromagnetic signal from the emergency vehicle using a communication module of the first vehicle; and wherein the instructions that, when executed, cause the one or more processors to receive, using the second vehicle, the second warning signal from the emergency vehicle and the recognition signal from the first vehicle comprise:

instructions that, when executed, cause the one or more processors to receive the electromagnetic signal from the emergency vehicle using a communication module of the second vehicle; and instructions that, when executed, cause the one or more processors to receive the recognition signal from the first vehicle using the communication module of the second vehicle.

* * * * *